US008246191B2

(12) United States Patent
Hu

(10) Patent No.: US 8,246,191 B2
(45) Date of Patent: Aug. 21, 2012

(54) WIND-DRIVEN LIGHT-EMITTING DEVICE

(76) Inventor: Sun-Yuan Hu, Peng Hu County (TW)

( * ) Notice: Subject to any disclaimer, the term of this patent is extended or adjusted under 35 U.S.C. 154(b) by 92 days.

(21) Appl. No.: 12/756,467

(22) Filed: Apr. 8, 2010

(65) Prior Publication Data

US 2011/0249466 A1 Oct. 13, 2011

(51) Int. Cl.
*F21V 19/00* (2006.01)

(52) U.S. Cl. ..... 362/159; 362/35; 362/162; 290/44; 290/55

(58) Field of Classification Search ..... 362/35, 362/159, 170, 192, 249.02, 600, 604, 605, 362/612, 613, 615, 800; 290/44, 54, 55
See application file for complete search history.

(56) References Cited

U.S. PATENT DOCUMENTS 1,894,357 A * 1/1933 Manikowske et al. ..... 290/44
2,177,801 A * 10/1939 Erren ..... 290/55
4,039,848 A * 8/1977 Winderl ..... 290/55
5,506,453 A * 4/1996 McCombs ..... 290/44
6,476,513 B1 * 11/2002 Gueorguiev ..... 290/55
6,923,552 B2 * 8/2005 Tseng ..... 362/192
6,940,185 B2 * 9/2005 Andersen et al. ..... 290/44
2004/0105256 A1 * 6/2004 Jones ..... 362/159
2004/0247437 A1 * 12/2004 Otaki et al. ..... 416/132 B
2009/0268441 A1 * 10/2009 Chen ..... 362/192
2010/0230967 A1 * 9/2010 Heo ..... 290/44
2011/0206517 A1 * 8/2011 Antonov et al. ..... 416/170 R

* cited by examiner

*Primary Examiner* — Hargobind S Sawhney

(57) ABSTRACT

A wind-driven light-emitting device comprises a housing, a first shaft sleeving member, a second shaft sleeving member and a plurality of blades. The blades are coupled to a first shaft. The first shaft has a first speed-change gear driving a second speed-change gear of a rotating second shaft. The second shaft has a magnetic element. The second shaft sleeving member has a coil connected with a circuit. The circuit is connected to a plurality of light-emitting (or light-guiding) elements arranged on the blades. When the device is windward, wind propels the blades to rotate. Thus, the magnetic element of the second shaft is rotated to induce voltage on the coil. The circuit rectifies, boosts, stabilizes and regulates the power to drive the light-emitting (or light-guiding) elements. Thereby, the present invention provides a decorative lighting effect without using any external electric power.

4 Claims, 4 Drawing Sheets

WIND-DRIVEN LIGHT-EMITTING DEVICE

BACKGROUND OF THE INVENTION

1. Field of the Invention

The present invention relates to a wind-driven light-emitting device, particularly to a wind-driven light-emitting device, which can emit light without using any external electric power, wherein wind propels the blades, and the magnetic element coupled to the blades is rotated to induce voltage on a coil, whereby the light-emitting (or light-guiding) elements on the blades are driven by the voltage to emit light and provide a decorative lighting effect.

2. Description of the Related Art

General decorative light-emitting devices are usually powered by batteries or commercial electricity. Because of the emerging environmental protectionism, many schemes are proposed to reduce power consumption, including the utilization of wind power. Wind power is a substitute energy able to reduce the consumption of fossil fuels. Based on many years' experience in the related field and via persistent research and experiment, the Inventor thus proposes a wind-driven light-emitting device, wherein wind is used to generate electricity and drive a light-emitting device, whereby is achieved energy efficiency and carbon reduction.

SUMMARY OF THE INVENTION

The primary objective of the present invention is to provide a wind-driven light-emitting device, wherein wind propels the blades to rotate, and the rotating blades drives the magnetic element to rotate and induce voltage on the coil, whereby the light-emitting (or light-guiding) elements installed on the blades are powered to emit light and provide a decorative lighting effect without using any external electric power.

The wind-driven light-emitting device of the present invention comprises a housing, a first shaft sleeving member, a second shaft sleeving member and a plurality of blades. The blades are coupled to a first shaft. The first shaft has a first speed-change gear driving a second speed-change gear of a second shaft to rotate. The second shaft has a magnetic element. The second shaft sleeving member has a coil connected with a circuit. The circuit is connected to a plurality of light-emitting (or light-guiding) elements arranged on the blades. When the device is windward, wind propels the blades to rotate. Thus, the magnetic element of the second shaft is rotated to induce voltage on the coil. The circuit rectifies, boosts, stabilizes and regulates the power to light up the light-emitting (or light-guiding) elements. Thereby, the present invention can provides a decorative lighting effect without using any external electric power. Thus is achieved energy efficiency and carbon reduction.

In the present invention, the light-emitting elements may be light-emitting diodes or organic light-emitting diodes. The light-guiding element integrates an optical fiber/acrylic material with a light emitter to provide diverse lighting effects.

DETAILED DESCRIPTION OF THE INVENTION

Figure 1:
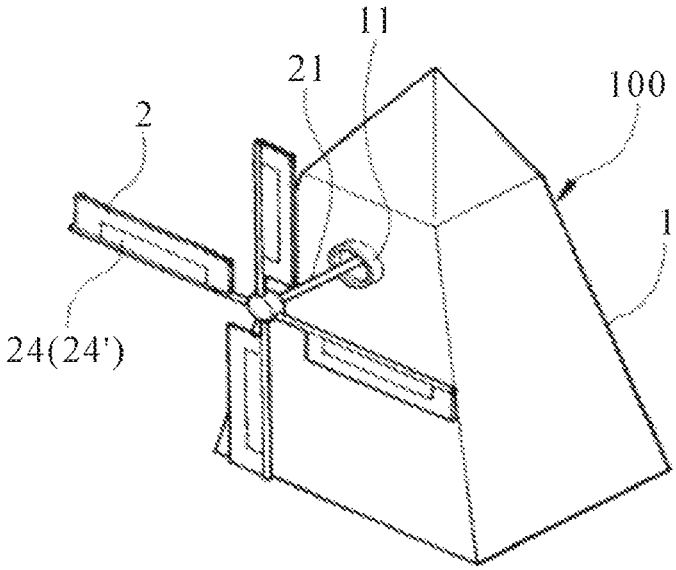
FIG. 1 is a perspective view schematically showing a wind-driven light-emitting device according to a first embodiment of the present invention.
Figure 2:
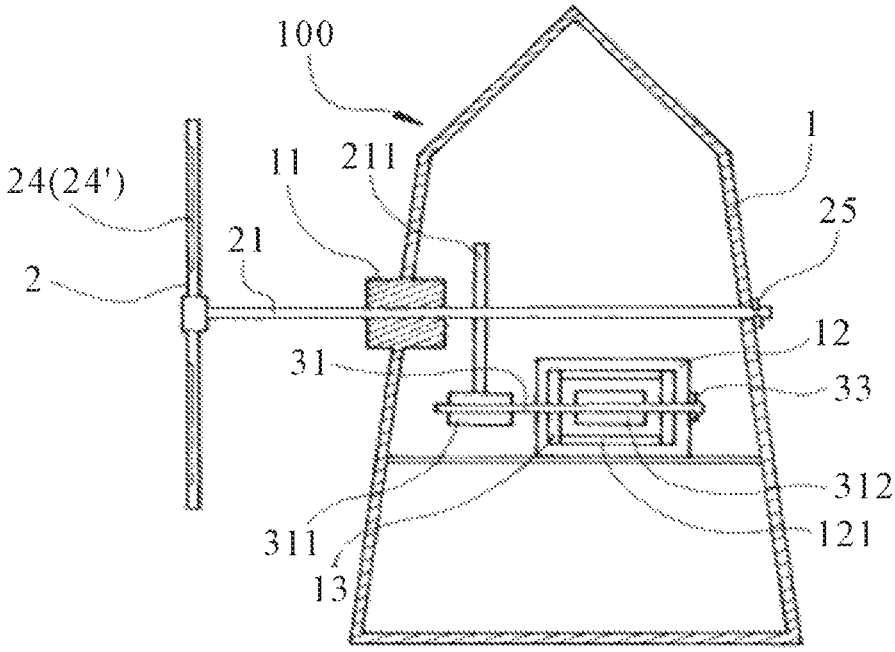
FIG. 2 is a sectional view schematically showing a wind-driven light-emitting device according to the first embodiment of the present invention.

Refer to FIG. 1 and FIG. 2 a perspective view and a sectional view of a wind-driven light-emitting device according to a first embodiment of the present invention. The device of the present invention comprises a tower-like or pillar-like housing 1 and a plurality of blades 2. The upper portion of the housing 1 has a first shaft sleeving member 11.

The ends of the blades 2 are jointly connected to a first shaft 21. The first shaft 21 has a first speed change gear 211. The first speed change gear 211 transmits mechanical energy to a second speed change gear 311 of a second shaft sleeving member 12 and drives a second shaft 31 to rotate. A magnetic element 312 is installed at one end of the second shaft 31. The second shaft 31 is positioned by a second fastener 33. The second shaft sleeving member 12 has a coil 121, and the coil 121 is connected with a circuit 13 containing rectifiers, boosters, voltage stabilizers and current regulators. The circuit 13 is connected with at least one light-emitting element 24 (or at least one light-guiding element 24') emitting different colors of light. The light-emitting elements 24 (or light-guiding elements 24') are installed on the blades 2 and visible externally. The first shaft 21 where the blades 2 are installed passes through the first shaft sleeving member 1 and is positioned by a first fastener 25. Thereby, the blades 2 can rotate free. The light-emitting element 24 may be a light-emitting diode or an organic light-emitting diode. The light-guiding element 24' is a combination of an optical fiber/acrylic material and a light emitter.

Thus is constructed a wind-driven light-emitting device 100. When the wind-driven light-emitting device 100 is windward, wind propels the blades 2 to rotate. Thus, the magnetic element 312, which is installed on the second shaft 31, is driven to rotate along the same direction. The magnetic field of the rotating magnetic element 312 induces voltage on the coil 121. Via the rectifiers, boosters, voltage stabilizers and current regulators of the circuit 13, the voltage drives the light-emitting elements 24 (or light-guiding elements 24') on the blades 2 to light up. Thereby, the device of the present invention is powered to emit light and provide a decorative lighting effect.

The light-emitting elements 24 may be common light-emitting diodes, which emit identical color or different colors of light. Alternatively, the light-emitting elements 24 are the emerging organic light-emitting diodes. The colorful organic light-emitting diodes can implement the device of the present invention to provide a better decorative lighting effect.

Figure 3:
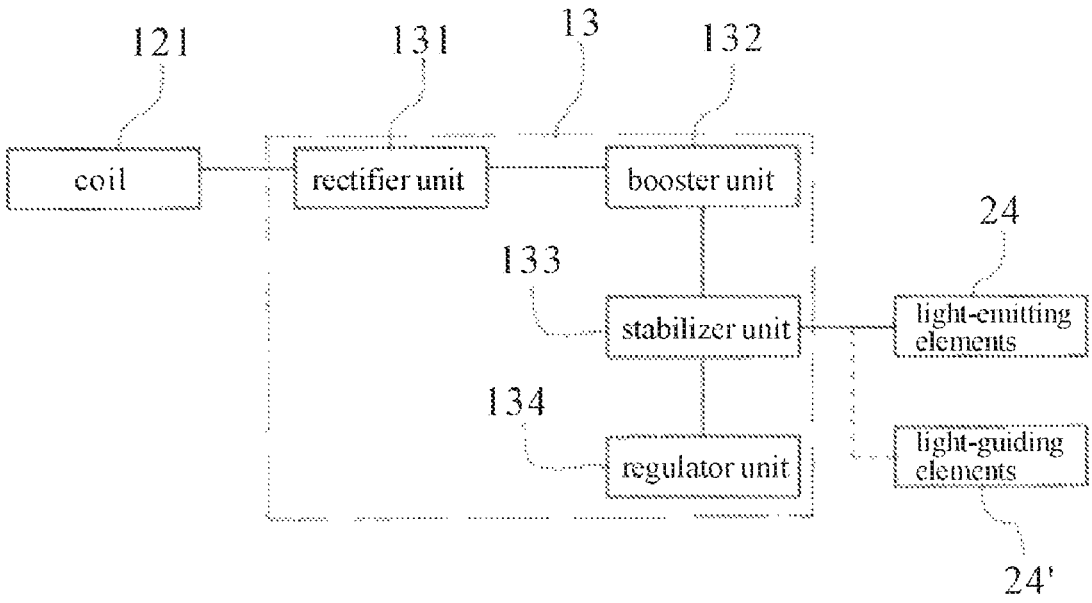
FIG. 3 is a block diagram schematically showing the circuit of a wind-driven light-emitting device according to a second embodiment of the present invention.

Refer to FIG. 3 a block diagram schematically showing the circuit of a wind-driven light-emitting device according to a second embodiment of the present invention. The circuit of the device of the present invention at least includes a rectifier unit 131 connected with the coil 121, a booster unit 132 connected with the rectifier unit 131 and also includes a stabilizer unit 133 and a regulator unit 134 both connected to the booster unit 132. When the coil 121 is induced to generate AC voltage, the rectifier unit 131 rectifies the AC voltage into DC voltage. The booster unit 132 raises the voltage to a given value. The stabilizer unit 133 and regulator unit 134 provides stabilized voltage and current for the light-emitting elements 24 (or light-guiding elements 24').

Figure 4:
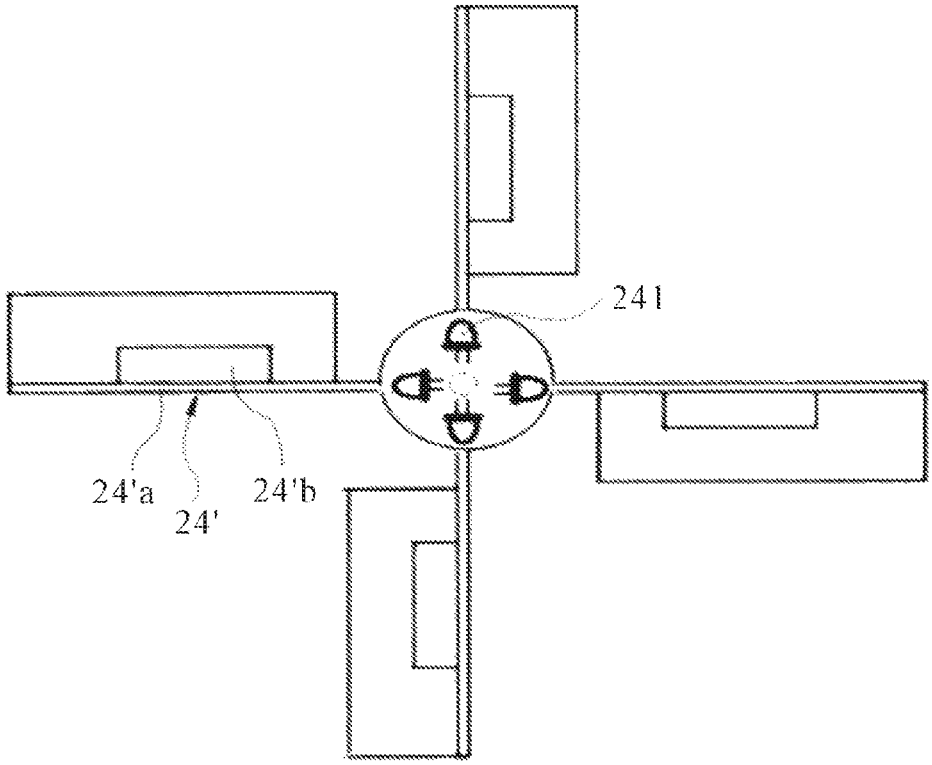
FIG. 4 is a partially-enlarged view schematically showing a wind-driven light-emitting device according to a third embodiment of the present invention.

In another embodiment, light-guiding elements 24' replace the light-emitting elements 24. Each light-guiding element 24' uses an optical fiber/acrylic material and a light emitter 241 to perform the same function as the light-emitting element 24. Refer to FIG. 4 a partially-enlarged view of this embodiment. In this embodiment, each of the light-guiding elements 24', which replace the light-emitting elements 24, has a first portion 24'*a* and a second portion 24'*b* and also has a light emitter 241 arranged near the shaft of the blades. The light emitter 241 is electrically connected with the circuit 13. The light-guiding element 24' is arranged beside the light emitter 241 to guide the light emitted by the light emitter 241. The first portion 24'*a* and the second portion 24'*b* of the light-guiding element 24' are made of an optical fiber, an acrylic material, or another light-guiding material according to requirement.

Figure 5:
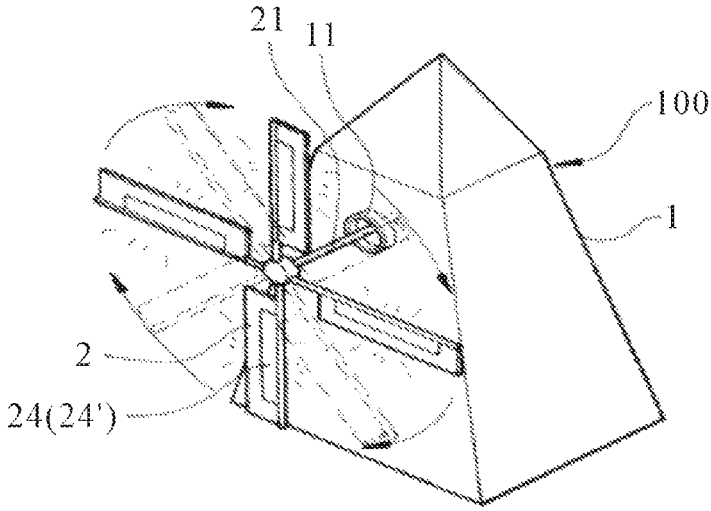
FIG. 5 is a diagram schematically the operation of a wind-driven light-emitting device according to the first embodiment of the present invention.

Refer to FIG. 5 a diagram schematically the operation of a wind-driven light-emitting device according to the first embodiment of the present invention, and refer to FIG. 2 again. When the wind-driven light-emitting device 100 is windward, wind propels the blades 2 to rotate. The first speed change gear 211 of the first shaft 21 transmits the mechanical energy to the second speed change gear 311 of the second shaft 31. Then, the magnetic element 312, which is coupled to the second shaft 31, rotates rapidly and induces voltage on the coil 121. The circuit 31 rectifies the current and boosts the voltage to light up the light-emitting elements 24 (or light-guiding elements 24') arranged on the blades 2. Therefore, the device of the present invention can emit light to provide a decorative lighting effect without using any external electric power.

Figure 6:
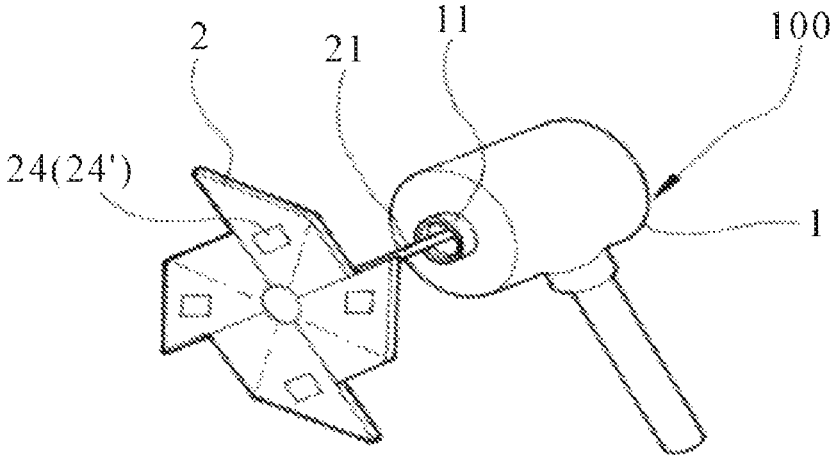
FIG. 6 is a perspective view schematically showing a wind-driven light-emitting device according to a fourth embodiment of the present invention.
Figure 7:
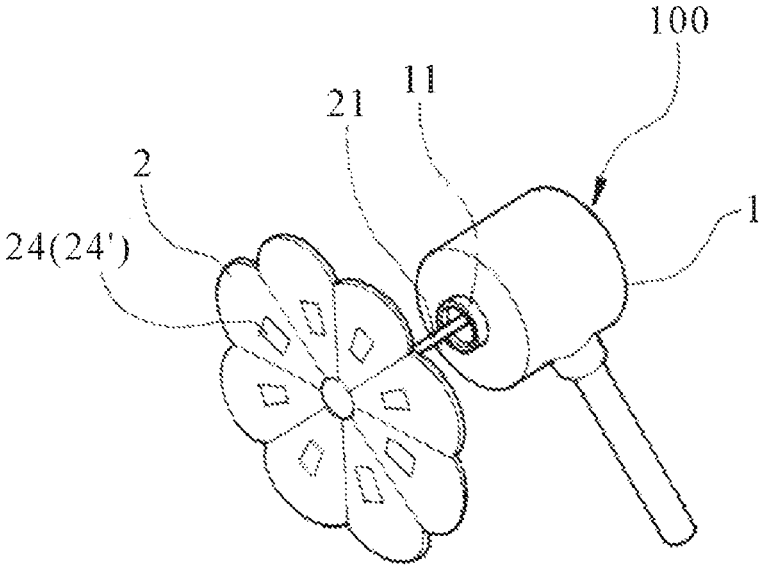
FIG. 7 is a perspective view schematically showing a wind-driven light-emitting device according to a fifth embodiment of the present invention.

Refer to FIG. 6 and FIG. 7 for a fourth embodiment and a fifth embodiment of the present invention, wherein the blades 2 are designed to have different shapes. As shown in FIG. 6, the blades 2 are designed to have a shape of a paper pinwheel with a holding rod installed below the housing 1. As shown in FIG. 7, the blades 2 are designed to have a shape of petals with a holding rod installed below the housing 1. Similarly, in the embodiments shown in FIG. 6 and FIG. 7, the rotation of the blades 2 drives the light-emitting elements 24 (or light-guiding elements 24') to emit light and provide a decorative lighting effect without using any external electric power.

In summary, the device of the present invention comprises a coil, a magnetic element and blades, wherein wind propels the blades to rotate, and the rotating blades drive the magnetic element to rotate, and the rotating magnetic element induces voltage on the coil, whereby the light-emitting elements on the blades are powered to emit light and provide a decorative lighting effect without using any external electric power.

The embodiments described above are only to exemplify the present invention but not to limit the scope of the present invention. Any equivalent modification or variation according to the scope of the present invention is to be also included within the scope of the present invention.

The light-emitting element or the light-guiding element as aforementioned may be commonly defined as: the "light element".

What is claimed is:

1. A wind-driven light-emitting device comprising:

a housing having a first sleeving member and a second sleeving member, wherein a first shaft and a second shaft are respectively installed in said first sleeving member and said second sleeving member, and wherein said first shaft and said second shaft respectively have a first speed change gear and a second speed change gear, and wherein said second shaft is rotated in said second sleeving member, and wherein said second sleeving member has a coil thereinside, and wherein said second speed change gear and a magnetic element are respectively installed on two ends of said second shaft; and a plurality of blades jointly coupled to said first shaft, wherein wind drives said blades and said first shaft to rotate, and wherein said first speed change gear on said first shaft rotates to drive said second speed change gear and said second shaft to rotate, and wherein said magnetic element on said second shaft is driven to rotate and induce voltage on said coil inside said second sleeving member, and wherein said coil is connected to a circuit, and wherein said circuit is connected with at least one light element selected from the group consisting of a light-emitting element arranged on said blade to be visible externally; and a light emitter arranged near the first shaft of the blades, and a light-guiding element made of optical fiber arranged beside the light emitter and arranged on said blade to guide light from the light emitter to be visible externally.

2. The wind-driven light-emitting device according to claim 1, wherein said first shaft passes through said first sleeving member and is positioned with a first fastener to enable said blades to rotate free.

3. The wind-driven light-emitting device according to claim 1, wherein said light-emitting element is selected from the group consisting of a light-emitting diode and an organic light-emitting diode.

4. The wind-driven light-emitting device according claim 1, wherein said circuit that is connected with said coil at least includes a rectifier unit converting AC power into DC power, a booster unit raising DC power to a given voltage, a voltage stabilizer and a current regulator.

* * * * *